US007077798B2

(12) United States Patent
Kawatsu et al.

(10) Patent No.: US 7,077,798 B2
(45) Date of Patent: Jul. 18, 2006

(54) SHEET FOLDING APPARATUS, SHEET FOLDING METHOD AND IMAGE FORMING APPARATUS

(75) Inventors: Kenji Kawatsu, Machida (JP); Toshio Shida, Higashiyamato (JP); Hiroyuki Wakabayashi, Hachioji (JP); Masaaki Uchiyama, Hachioji (JP); Masato Hattori, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 10/851,782

(22) Filed: May 21, 2004

(65) Prior Publication Data

US 2005/0020425 A1 Jan. 27, 2005

(30) Foreign Application Priority Data

Jul. 24, 2003 (JP) ..... 2003-278787

(51) Int. Cl.
*B31F 1/10* (2006.01)

(52) U.S. Cl. ..... 493/421; 493/429; 493/434; 493/444

(58) Field of Classification Search ..... 493/421, 493/429, 434, 435, 436, 440, 442, 444; 270/41
See application file for complete search history.

(56) References Cited

U.S. PATENT DOCUMENTS

| | | | | |
|---|---|---|---|---|
| 1,752,415 | A * | 4/1930 | Campbell | 493/360 |
| 4,569,672 | A * | 2/1986 | Marion et al. | 493/359 |
| 4,909,779 | A * | 3/1990 | Schaffron | 493/235 |
| 5,125,633 | A * | 6/1992 | Fecker et al. | 270/51 |
| 5,267,933 | A * | 12/1993 | Precoma | 493/23 |
| 5,437,596 | A * | 8/1995 | Bogdan et al. | 493/420 |
| 5,514,066 | A * | 5/1996 | Monaco | 493/25 |
| 5,520,603 | A * | 5/1996 | Bluthardt et al. | 493/421 |
| 6,024,682 | A * | 2/2000 | Mandel et al. | 493/23 |
| 6,086,522 | A * | 7/2000 | Hechler | 493/23 |
| 6,171,225 | B1 * | 1/2001 | Nonoyama et al. | 493/16 |
| 6,206,816 | B1 * | 3/2001 | Cook et al. | 493/420 |
| 6,526,256 | B1 | 2/2003 | Yoshie et al. | |
| 6,656,103 | B1 * | 12/2003 | Neubauer et al. | 493/434 |
| 6,746,390 | B1 * | 6/2004 | Tamura et al. | 493/445 |

FOREIGN PATENT DOCUMENTS

| | | |
|---|---|---|
| JP | 2002-60127 | 2/2002 |
| JP | 2002-284444 | 10/2002 |

* cited by examiner

*Primary Examiner*—Stephen F. Gerrity
*Assistant Examiner*—Hemant M. Desai
(74) *Attorney, Agent, or Firm*—Cantor Colburn LLP

(57) ABSTRACT

To avoid displacement of the fold formed on a sheet and misalignment between sheets when a fold is formed on a bundle of sheets stacked one on top of another, a sheet folding apparatus, for forming a plurality of folds on the sheet on which an image is formed, includes a first folding section and a second folding section. The first folding section has a first folding roller, a second folding roller in contact with the first roller, and a first folding plate member for inserting the first fold of the sheet between the first and second folding rollers. The second folding section has the second folding roller, a third folding roller in contact with the second folding roller provided downstream from the first folding roller in the sheet feeding direction, and a second folding plate member for inserting the second fold of the sheet between the second and third folding rollers. After the first fold has been formed on the sheet in the first folding section, the second fold of the sheet is formed in the second folding section.

11 Claims, 11 Drawing Sheets

FIG. 8 ( a )
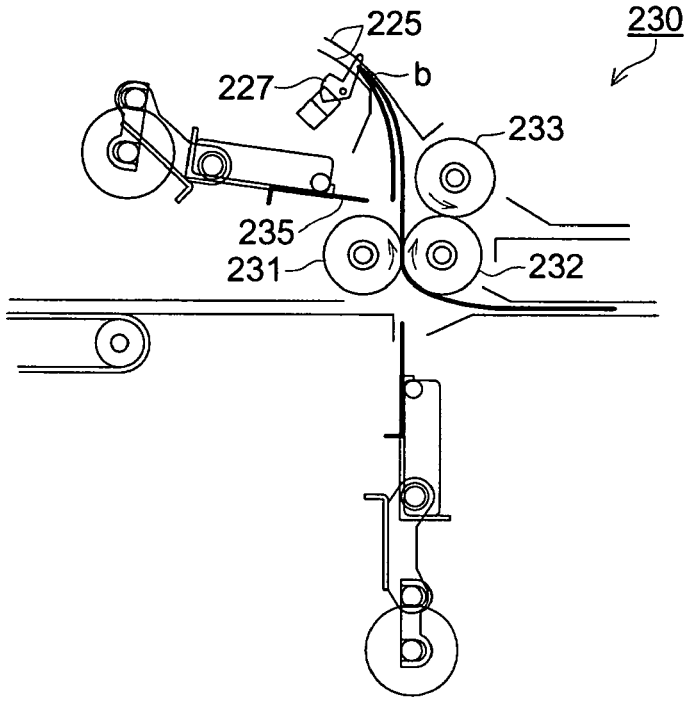
FIG. 8 ( b )
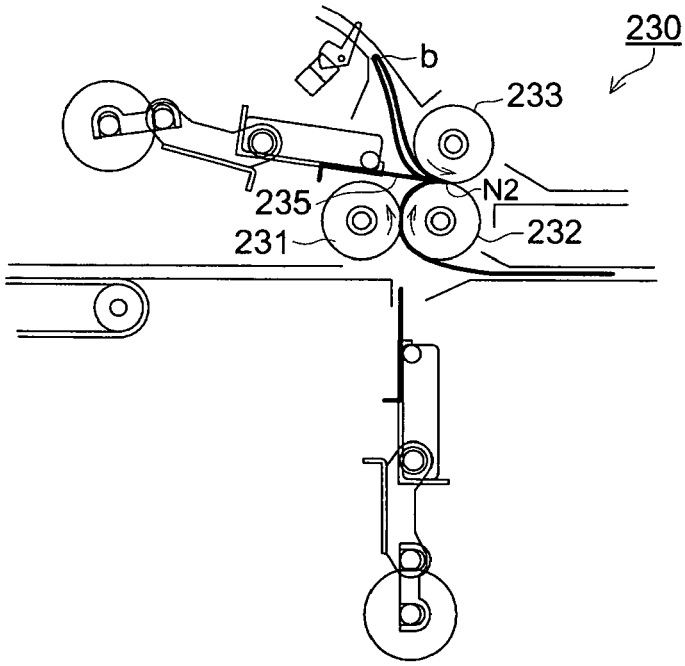

FIG. 10 ( a )
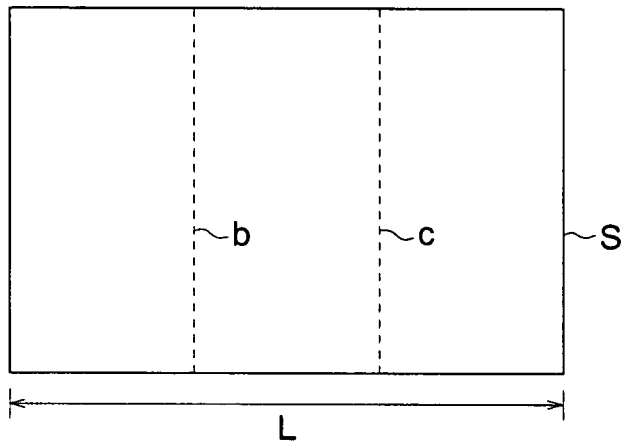
FIG. 10 ( b )
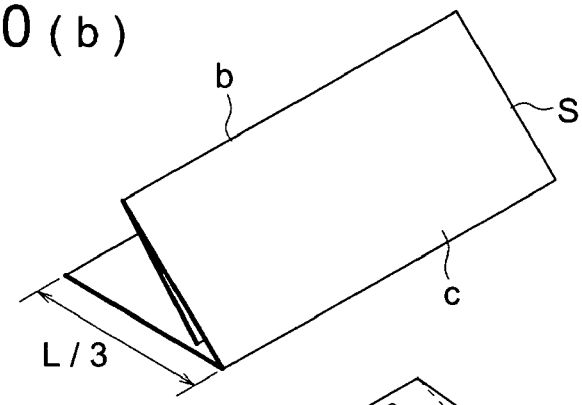
FIG. 10 ( c )
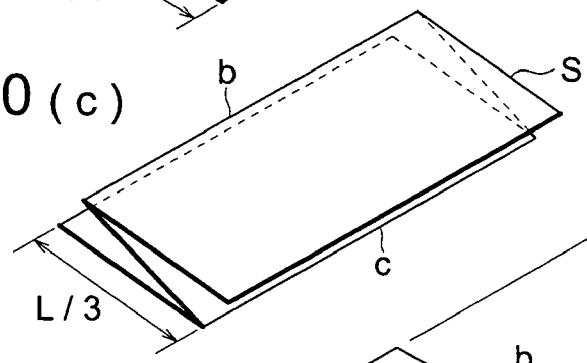
FIG. 10 ( d )
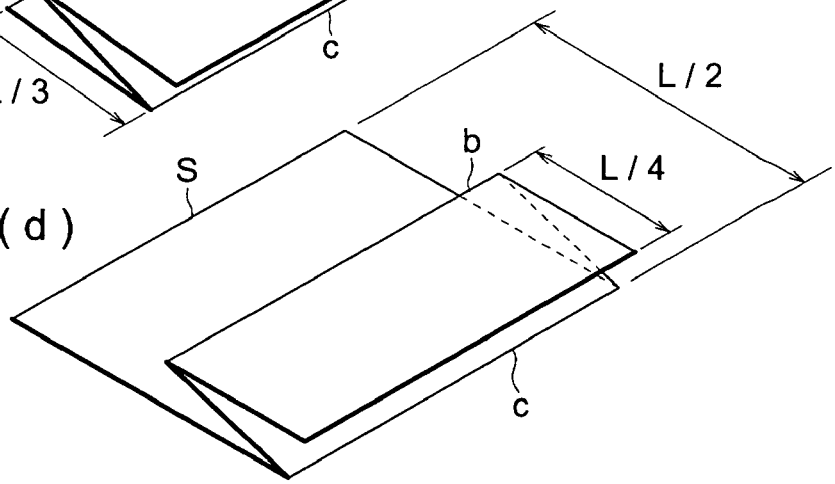

SHEET FOLDING APPARATUS, SHEET FOLDING METHOD AND IMAGE FORMING APPARATUS

BACKGROUND OF THE INVENTION

1. Field of the Invention

The present invention relates to a sheet folding apparatus, a sheet folding method and an image forming apparatus wherein the sheet folding apparatus and the sheet folding method are intended to ensure that a sheet with image recorded thereon, ejected from an image forming apparatus, is folded in two or more.

2. Description of Related Art

The prior art disclosed so far includes a sheet folding apparatus consisting of a copying machine as an image forming apparatus, having a function of folding sheets with image recorded thereon, and a post-processing apparatus having a function of folding and binding the sheets.

Further, a sheet folding apparatus for folding one or a few sheets of sheets in two or three is also utilized as an apparatus for creating a sealed document such as postal matter.

In the sheet folding apparatus disclosed in the Japanese Application Patent Laid-Open Publication No. 2002-284444, two or more folds are formed on a sheet of sheet subjected to image forming processing, using a plurality of pairs of folding rollers and a sheet leading end stopping member, and Z-shaped fold processing is performed. This sheet folding apparatus stops the leading edge of the sheet having been transported, by hitting it against a sheet leading edge stopping member. The deflected portion of the sheet caused by this sheet leading edge stopping member is placed between a pair of folding roller, thereby forming a fold.

The post-processing apparatus disclosed in the Japanese Application Patent Laid-Open Publication No. 2002-60127 is equipped with a first folding section and a second folding section. When the twofold mode is selected by a selection section, the first folding section is actuated to fold the sheet into two and to eject it. When the threefold mode is selected by the selection section, the first folding section is actuated to fold the sheet. Then the second folding section is operated to fold the sheet again, whereby the sheet is folded into three and is ejected. The first folding section produces the first fold using the first pair of rollers and folding knife, and the second folding section uses the produces the fold by allowing the deflected portion of the sheet crated by the sheet leading edge stopping member, to be inserted between the second pair of rollers.

According to the sheet folding apparatus described in the Japanese Application Patent Laid-Open Publication No. 2002-284444, the fold produced on the sheet is displaced by the difference in the thickness and strength (stiffness) of the sheet in some cases.

In the post-processing apparatus shown in Japanese Application Patent Laid-Open Publication No. 2002-60127, when a plurality of sheets of sheets are stacked one on top of another into a bundle of sheets to produce a fold thereon, the outside sheet in contact with the outer peripheral surface of the folding roller is first caught between the folding roller, and the outside sheet is folded in the state displaced from the inside sheet. This has created a problem in this prior art.

SUMMARY

The first aspect of the present invention concerns a sheet folding apparatus, for forming a plurality of folds on the sheet on which an image is formed, having a first folding section and a second folding section. The first folding section has a first folding roller, a second folding roller in contact with the first roller, and a first folding plate member for inserting the first fold of the sheet between the first and second folding rollers. The second folding section has the second folding roller, a third folding roller in contact with the second folding roller provided downstream from the first folding roller in the sheet feeding direction, and a second folding plate member for inserting the second fold of the sheet between the second and third folding rollers. After the first fold has been formed on the sheet in the first folding section, the second fold of the sheet is formed in the second folding section.

The second aspect of the present invention concerns a sheet folding apparatus, for forming a plurality of folds on the sheet on which an image is formed, having a first folding section and a second folding section. The first folding section has a first folding roller, a second folding roller in contact with the first roller, and a first folding plate member for inserting the first fold of the sheet between the first and second folding rollers. The second folding section has a third folding roller provided downstream from the first and second folding rollers in the sheet feeding direction, a fourth roller in contact with the third folding roller, and a second folding plate member for inserting the second fold of the sheet between the third and fourth folding rollers. After the first fold has been formed on the sheet in the first folding section, the second fold of the sheet is formed in the second folding section.

The third aspect of the present invention concerns an image forming apparatus having an image forming section for recording an image on a sheet, and a sheet folding apparatus for forming a plurality of folds on the sheet with the image.

The sheet folding apparatus is a sheet folding apparatus for forming a plurality of folds on the sheet with the image formed thereon, and has a first folding section and a second folding section. The first folding section has a first folding roller, a second folding roller in contact with the first roller, and a first folding plate member for inserting the first fold of the sheet between the first and second folding rollers. The second folding section has the second folding roller, a third folding roller in contact with the second folding roller downstream from the first folding roller in the sheet feeding direction, and a second folding plate member for inserting the second fold of the sheet between the second and third folding rollers. After the first fold has been formed on the sheet in the first folding section, the second fold of the sheet is formed in the second folding section.

BRIEF DESCRIPTION OF THE DRAWINGS

FIGS. 8(*a*) and 8(*b*) each is a cross sectional view showing the second folding step in threefold processing;

FIG. 10(*a*) to 10(*d*) each is a developed plan showing a sheet to be internally folded in three and a perspective view showing the sheet having been subjected to threefold processing.

DETAILED DESCRIPTION OF THE PREFERRED EMBODIMENT

Figure 1:
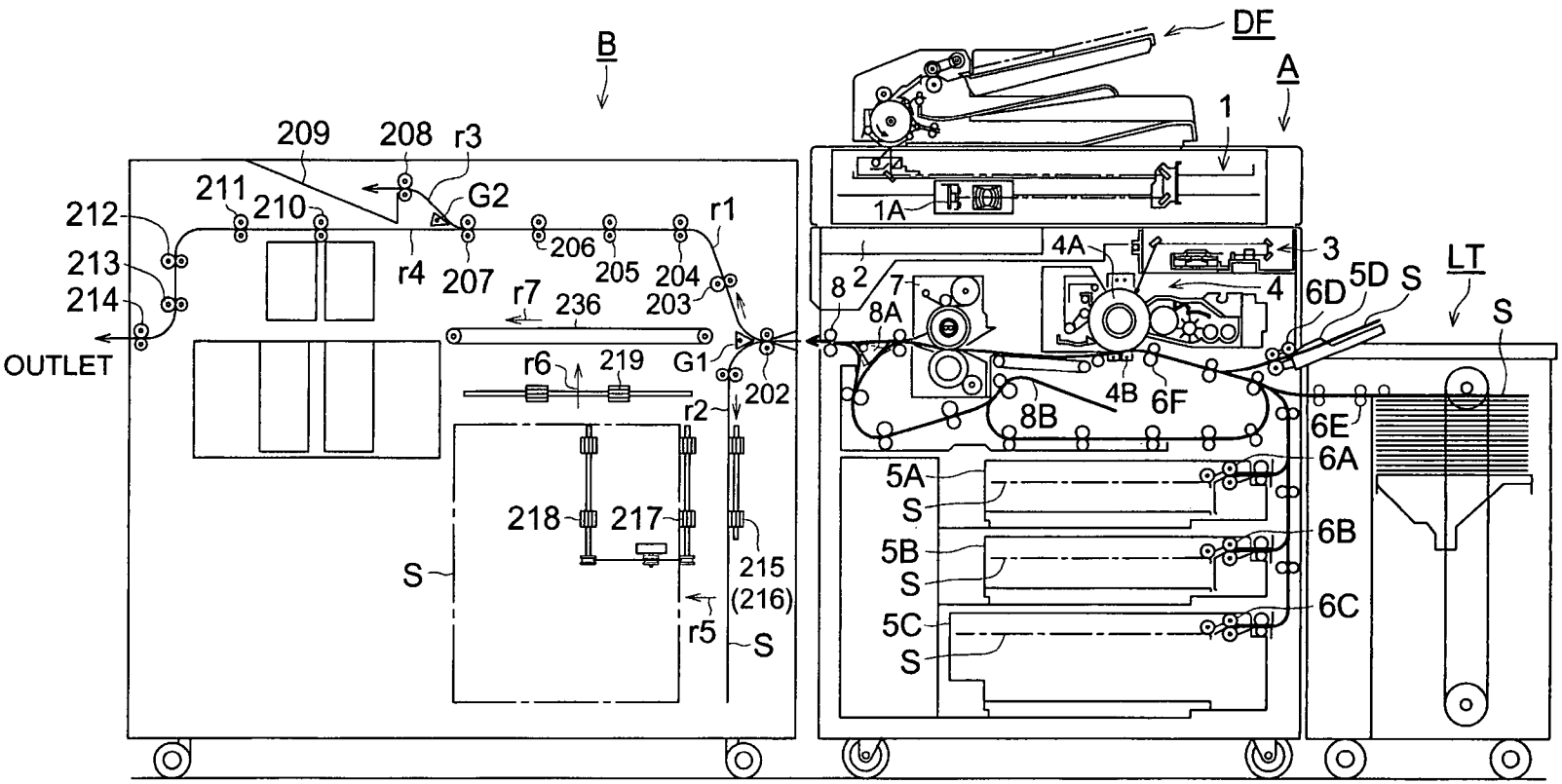
FIG. 1 is a block diagram representing the overall configuration of an image forming system consisting of an image forming apparatus, an automatic document feeding apparatus, a post-processing apparatus and a high-volume paper supply apparatus.

Referring to the drawing, the following describes a sheet folding apparatus, a post processing apparatus equipped with the sheet folding apparatus and an image forming apparatus equipped with the post processing apparatus according to the present invention:

[Image Forming Apparatus]

FIG. 1 is a block diagram representing the overall configuration of an image forming system consisting of an image forming apparatus A, an automatic document feeding apparatus DF, a post-processing apparatus B and a high-volume paper supply apparatus LT.

The image forming apparatus A consists of an image scanning section (image input apparatus) 1, an image processing apparatus 2, an image write section 3, an image forming section 4, paper supply cassettes 5A, 5B and 5C, a manual feed tray 5D, a first paper supply sections 6A, 6B, 6C, 6D and 6E, a second paper supply section 6F, a fixing apparatus 7, ejection section 8, and an automatic paper supply section (ADU) 8B for double-sided copying.

The automatic document feeding apparatus DF is mounted on the top of the image forming apparatus A. The post-processing apparatus B is installed on the side of the ejection section 8 illustrated on the left of the image forming apparatus A.

The image on one side or both sides of the document placed on the document glass of the automatic document feeding apparatus DF is scanned by the optical system of the image scanning section 1, and is read into the image sensor CCD.

The analog signal photoelectrically converted by the image sensor CCD is sent to the image write section 3 after analog processing, analog-to-digital conversion, shading correction and image compression in the image processing apparatus 2.

In the image write section 3, the light outputted from the semiconductor laser is applied to a photoconductor drum 4A, whereby a latent image is formed. In the image forming section 4, electric charging, exposure, development, transfer, separation, cleaning and other processing are carried out. An image is transferred by the transfer section 4B onto the sheet S fed by each of the first paper supply sections 6A, 6B, 6C, 6D and 6E from the paper supply cassettes 5A, 5B and 5C, manual feed tray 5D and high-volume paper supply apparatus LT. The sheet S carrying the image is fixed by the fixing apparatus 7 and is fed into the post-processing apparatus B from the ejection section 8.

Alternatively, the sheet S, having undergone single-sided image processing, fed into the automatic paper supply section 8B for double-sided copying by the transfer section 8A is subjected to double-sided image processing again in the image forming section 4, and is then ejected from the ejection section 8.

[Post-Processing Apparatus]

Figure 2:
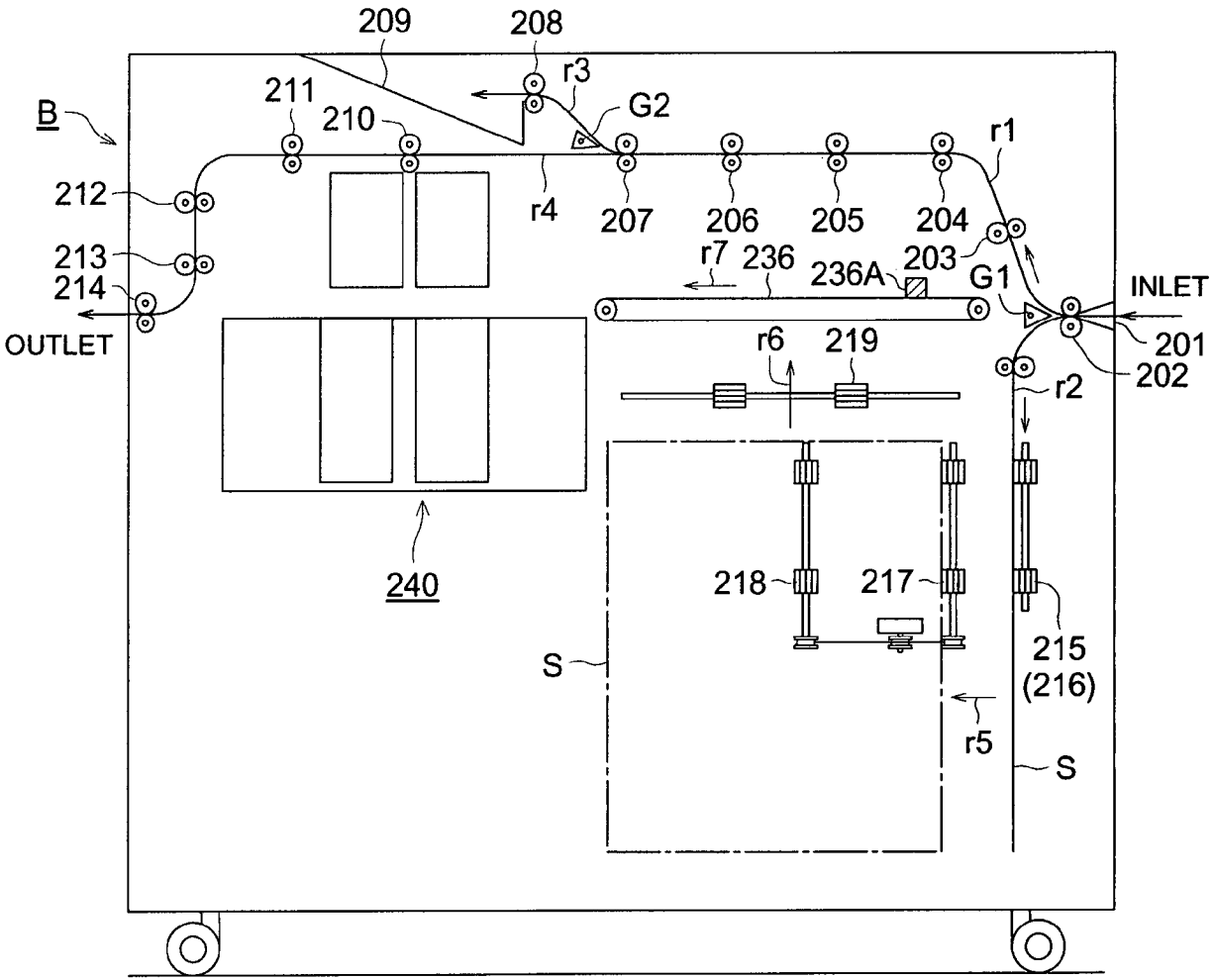
FIG. 2 is a front view of the post-processing apparatus.
Figure 3:
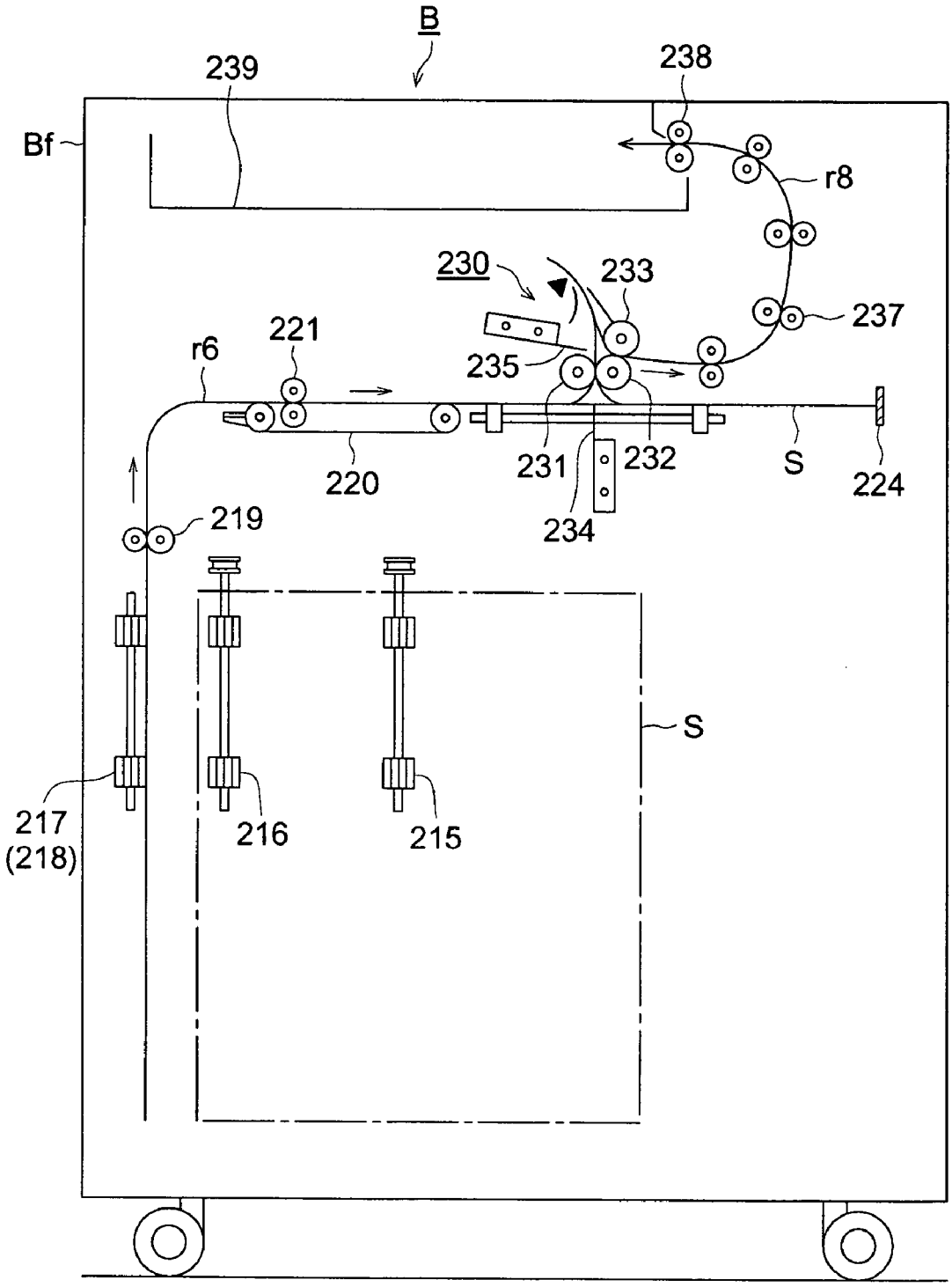
FIG. 3 is a right side view of the post-processing apparatus.
Figure 4:
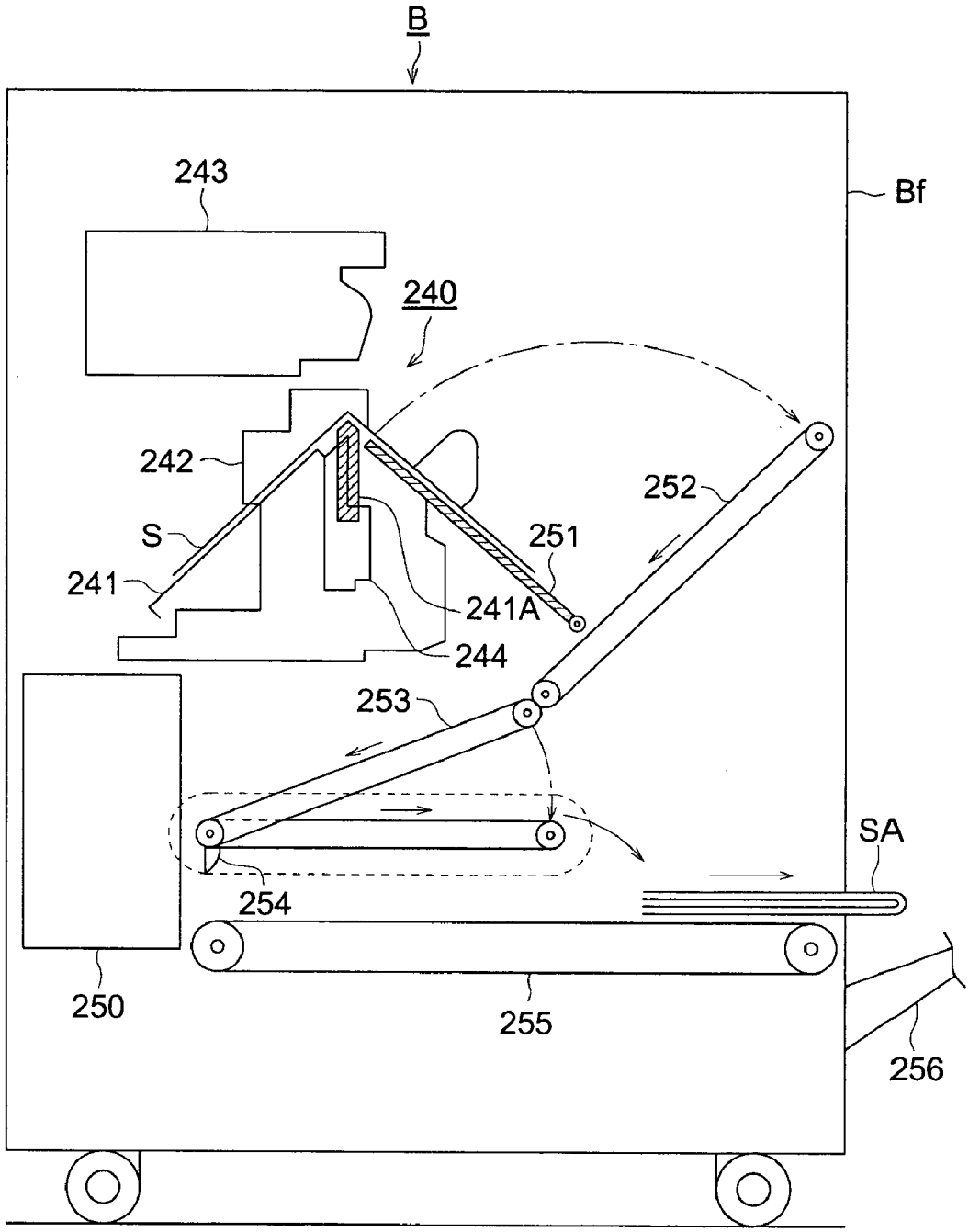
FIG. 4 is a left side view of the post-processing apparatus.
Figure 5:
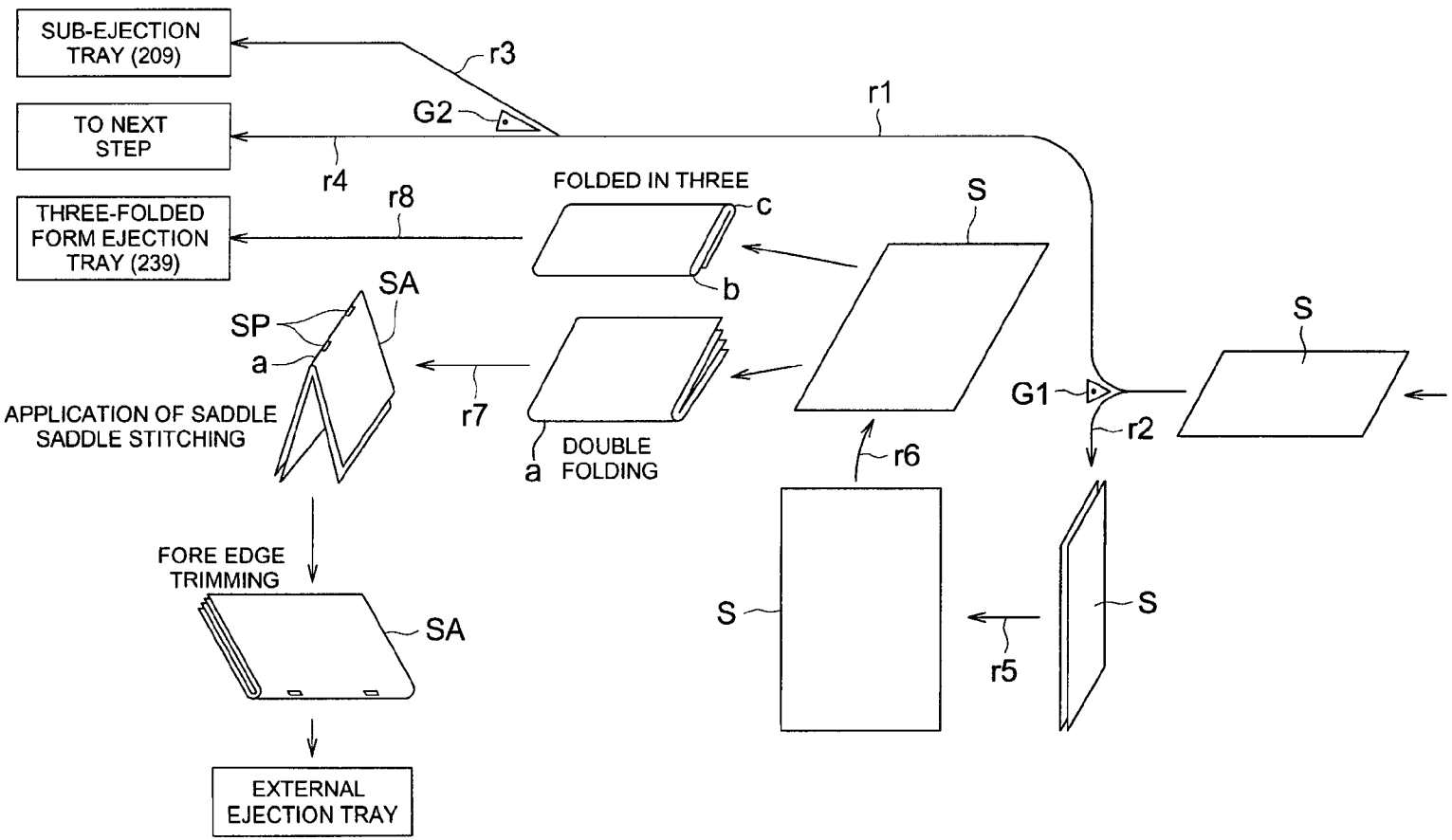
FIG. 5 is a schematic diagram representing the sheet transport process of the post-processing apparatus.

FIG. 2 is a front view of the post-processing apparatus, FIG. 3 a right side view and FIG. 4 a left side view. FIG. 5 is a schematic diagram representing the sheet transport process of the post-processing apparatus B.

The sheet S, ejected from the image forming apparatus A or other post-processing apparatus and led into the inlet (loading port) 201 of the post-processing apparatus B, is sandwiched between the inlet rollers 202 and is transported to either the upper transport path r1 and lower transport path r2 of the transport path switching section G1.

Te sheet S transported to the transport path r1 is sandwiched between the transport rollers 203 through 207 and is transported to either the upper transport path r3 or lower transport path r4 of the transport path switching section G2.

The sheet S transported to the upper transport path r3 is ejected by the ejection roller 208 and is stacked on the sub-ejection tray (top tray) arranged on the upper portion of the post-processing apparatus B.

The sheet S transported to the lower transport path r4 is transported sandwiched between transport rollers 210 through 213, and is ejected by the ejection roller 214.

<Transport by First Rectangular Deflection>

The sheet S transported to the lower transport path r2 of the transport path switching section G1 falls almost perpendicularly and temporarily stops at a predetermined position to be accommodated in position. At this temporary stop position, a small number of succeeding sheets S are stacked one on top of another and is accommodated in position (solid line in FIG. 2 and one-dot chain line in FIG. 3).

<Transport by Second Rectangular Deflection>

The accommodated sheet S is deflected and moved in the direction perpendicular to the paper surface shown in FIG. 2, by the transport rollers 215 through 218 and the guide plate (not illustrated). It passes through the transport path r5 leading to the front side Bf inside the post-processing apparatus B, with the paper surface kept upright, and stops at a predetermined position temporarily (one-dot chain line in FIG. 2 and solid line in FIG. 3).

<Transport by Third Rectangular Deflection>

After the sheet S is transported upward in the perpendicular direction by the transport roller 219, it is deflected in the horizontal direction and is moved to the rear side inside the post-processing apparatus B by the transport alignment belt 220 and transport roller 221 (transport path r6).

<Double-Folding Function>

A folding process section (sheet folding apparatus) 230 is arranged downstream from the transport alignment belt 220 in the sheet transport direction. The folding process section 230 consists of a first folding roller 231, second folding roller 232, third folding roller 233, first folding plate member 234 and second folding plate member 235.

A small number of sheets S having reached the folding process section 230 are sandwiched between the first folding roller 231 and second folding roller 232 rotating in the direction opposite to each other, and the first folding plate member 234 moving in a straight line. A fold "a" is formed across the sheet width at the double-position in the sheet transport direction (FIG. 5).

After that, the first folding roller 231 and second folding roller 232 are driven in the reverse direction. The sheet S with the fold "a" produced thereon is detached from first folding roller 231 and second folding roller 232, and is returned to the original horizontal transport path. The sheet S is transported to the transport path r7 (arrow-marked direction in FIG. 2) in the direction of the extension line of the fold "a" (direction perpendicular to the paper surface in FIG. 3) by a transport pawl 236A (FIG. 2) secured on a rotating transport belt 236. It is then fed into the saddle stitching section 240 shown in FIG. 4.

As described above, the folding process section 230 applies processing of double folding to a small number of sheets S to give a clear and firm fold "a". The folds are sequentially sent into the saddle stitching section 240, thereby producing a high-quality booklet (in bound sheet) SA containing a little bulge of the fold "a".

<Saddle Stitching Function>

The sheet S having undergone the processing of double folding in the folding process section 230 is fed toward the transport path r7 by the transport belt 236 and a guide (not illustrated) and is placed on the saddle application/stacking member 241 of the saddle stitching section 240 shown in FIG. 5. Then the succeeding double-folded sheets S pass through the transport path r7 and are stacked on the saddle application/stacking member 241.

The saddle application/stacking member 241 consists of two guide plates approximately orthogonal to each other. On the top of the saddle application/stacking member 241, the pressure member 241A capable of vertical movement by being energized by a spring is arranged supported by a side gauge receiving mechanism 243.

The top of the pressure member 241A convex shape approximately at right angles upward, and the fold "a" (FIG. 5) of the double-folded sheet S is placed on the upper edge line.

A plurality of sheets S mounted on the saddle application/stacking member 241 and pressure member 241A have their positions aligned by a width aligning member 242.

A side gauge receiving mechanism 243 is fixed over the saddle application/stacking member 241. Inside the saddle application/stacking member 241, the pressure member 241A and side gauge receiving mechanism 244 are arranged movably in the vertical direction.

Two sets of binding sections of two-piece structure each consisting of the side gauge receiving mechanism 243 and side gauge receiving mechanism 244 are arranged in the direction of the sheet fold. When the processing of double-folding has been set in the operation section, the side gauge receiving mechanism 244 goes up to perform saddle stitching. In other words, two sets of binding sections drive the binding side gauges SP at two positions specified at the center, along the fold "a" of the bundle of sheets on the pressure member 241A. The perspective view in FIG. 5 shows the booklet SA having undergone the process of double-folding and saddle stitching.

<Sheet Bundle Trimming Function>

A bundle of sheets having undergone saddle stitching by the saddle stitching section 240 is supported by the guide member 251 capable of being oscillated, and is oscillated in the direction indicated by a chain line to be placed on the transport belt 252. The bundle of sheets is transported downward to the right by the rotation of the transport belt 252, and is further moved by rotating transport belt 253 to stop at a predetermined position.

After that, the transport belt 253 oscillates and is set to the horizontal position. The fore edges (free end opposite to the fold) of the bundle of sheets mounted on this transport belt 253 placed in the horizontal position are misaligned due to the number of sheets of the booklet SA, so they are trimmed by a trimmer 250 to ensure that the fore edges are aligned.

The booklet SA produced after trimming is mounted on the transport belt 253 that rotates in the reverse direction, and is transported by the ejection pawl 254 fixed on the transport belt 253, with the rear of the booklet SA being pressed. It falls from the leading edge of the transport belt 253 in the arrow-marked direction. The fallen booklet SA is ejected by the rotating transport belt 253 into the ejection tray 256 arranged outside the front side Bf of the post-processing apparatus B.

[Folding]

Figure 6:
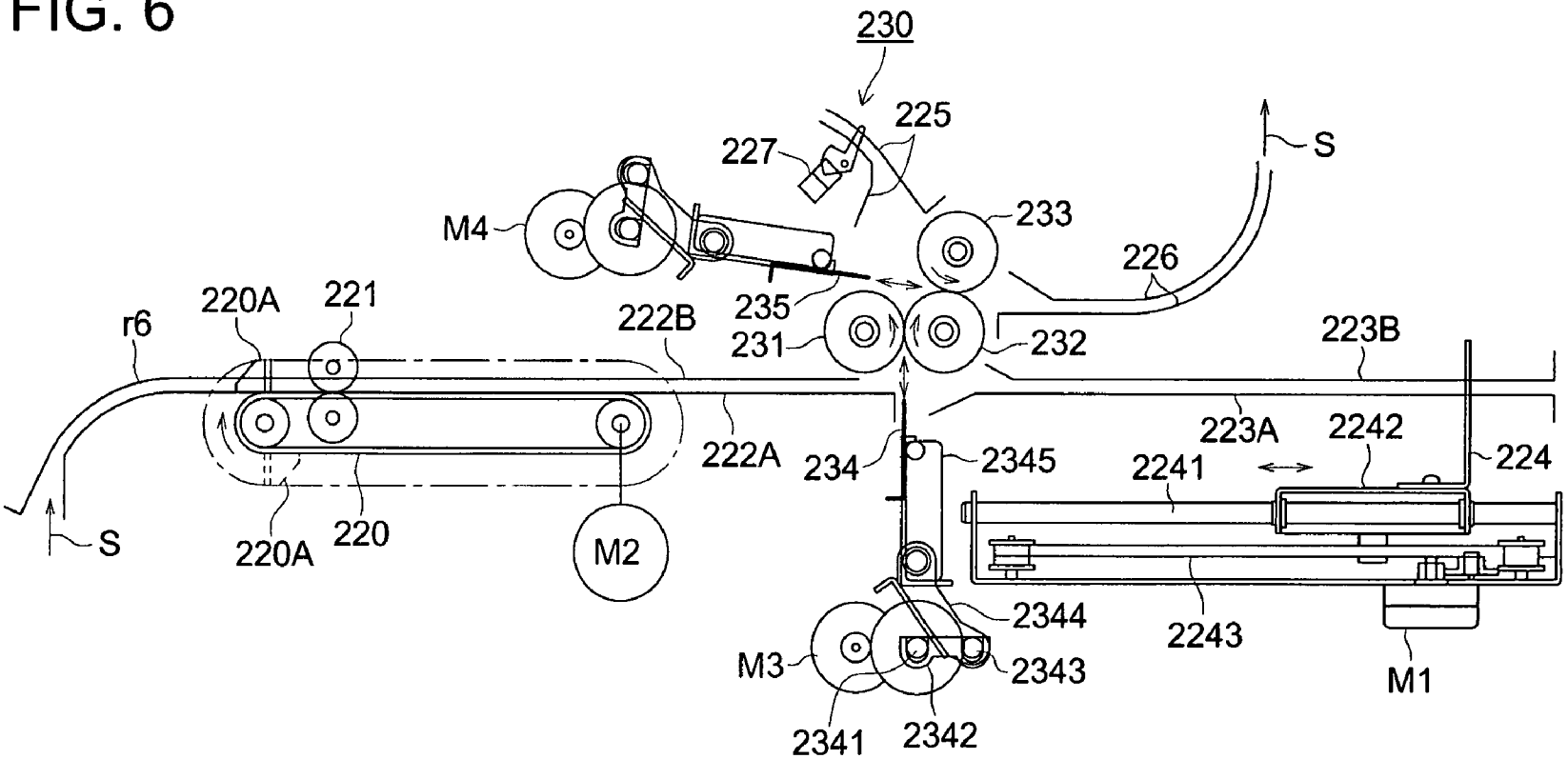
FIG. 6 is a cross sectional view of a folding section.

FIG. 6 is a cross sectional view of a folding process section 230. Double-folding and three folding are carried out by the folding process section 230.

<Sheet Transport and Alignment)

Sheets S traveling upward along the transport path r2 are sandwiched and transported by the transport rollers 221. They are transported by passing inside the transport pat r6 famed between the guide plates 222B and 223B.

After the trailing edges of the sheets S transported by being sandwiched between the transport rollers 221 have passed by the position where they are sandwiched between the transport rollers 221, the transport alignment belt 220 is driven by the motor M2. The alignment block (alignment pawl) 220A fixed to the transport alignment belt 220 travels by pressing the trailing edges of the sheets S in the traveling direction, where the sheets are mounted on the sheet stands 222A and 223A. It causes the trailing edges of the sheets S to abut the alignment member 224, whereby positioning is achieved.

The alignment member 224 slides along the guide bar 2241 and fixed by a support member 2242 capable of linear traveling. The support member 2242 is anchored to the belt 2243 that is driven by the motor M1 through a gear train, and travels in a straight line along the guide bar 2241.

A control section and a drive section moves the alignment member 224 to a predetermined position and stops it there, depending on the type of the sheet folding such as double-folding and three folding.

<Configuration of Folding Process Section>

The folding process section 230 is composed of a first folding process section, a second folding process section and a sheet guide.

The first folding section consists of a first folding roller 231, a second folding roller 232 in contact with the folding roller 231, and a knife-like first folding plate member 234 for inserting the first fold "b" of the sheets between the first folding roller 231 and second folding roller 232.

The second folding section consists of a second folding roller 232, a third folding roller 233 in contact with the second folding roller 232 downstream from the first folding roller 231 in the sheet feeding direction, and a knife-like second folding plate member 235 for inserting the second fold "C" of the sheet between the second folding roller 232 and third folding roller 233.

The sheet guide is composed of guide plates 225 and 226, and a stopping member for stopping the sheets S at a predetermined position. The stopping member has a detecting section 227 for detecting the passage of the fold "b" formed on the sheet S ejected from the first folding section.

The first folding roller 231 and second folding roller 232 are each supported rotatably by a support plate (not illustrated), and are held in the state of mechanical contact by the pressure member (not illustrated).

The motor (not illustrated) and drive transmission system cause the first folding roller 231 and second folding roller 232 to rotate in the directions opposite to each other in the state of mechanical contact.

The third folding roller 233 is kept in contact with the second folding roller 232 by a spring (not illustrated), and is driven to rotate.

The motor M3 drives the rotary shaft 2341 via the gear train so that the arm plate 2342 fixed to the rotary shaft 2341 is oscillated and rotated. The end of an arm plate 2342 is connected with one end of a link plate 2344 through a shaft 2343, and the other end of the link plate 2344 is connected to the end of the support member 2345. The support member 2345 can be moved in a straight line by a guide (not illustrated). The first folding plate member 234 is fixed onto the end portion by the support member 2345. The end of the first folding plate member 234 travels in a straight line toward the position where the first folding roller 231 and second folding roller 232 are kept in contact.

The support/traveling mechanism of the second folding plate member 235 is designed in the same configuration as that of the first folding plate member 234. It is driven by a motor. The end of the second folding plate member 235 travels in a straight the second folding roller 232 and third folding roller 233 are kept in mechanical contact.

It is preferred that this detecting section 227 be arranged in such a way that the portion of the first folding section where paper is overlapped is sandwiched between the roller 231 and roller 232, and, under this condition, the leading edge of paper is detected by a sensor. This arrangement allows the leading edge of the paper to be detected in a more stable state, and ensures improved detection accuracy and high precision determination of the position to be folded.

A knife-like member is used to configure the second folding section, and paper is stopped by the drive control of the first folding roller 231 and second folding roller 232. This arrangement eliminates the need of providing the hit stopping member for stopping the paper feed, and minimizes space requirements.

A pair of guide plates 225 are provided downstream from the contact position between the first folding roller 231 and second folding roller 232, and serve to guide the sheet S to pass by. Part of the guide plates 225 is provided with a detecting section 227 for detecting the leading edge of the sheet S traveling inside the guide plates 225. The detecting section 227 is composed of an optical sensor and actuator.

When the sheet S is folded into three, the first fold "b" has been formed on the sheet S by the first folding section consisting of the first folding roller 231 and second folding roller 232. After that, the second fold "c" is produced on the sheet S by the second folding section consisting of the second folding roller 232 and third folding roller 233.

The fold "b" of the sheet S folded into two by the first folding section leads the way to travel through the guide plates 225. The transport of the sheet S is stopped a predetermined time after the fold "b" of the sheet S has been detected by the detecting section 227, and the sheet S stops at a predetermined position temporarily. The position where the sheet S stops defers according to the size of the sheet and type of the folding in three.

A pair of guide plates 226 are arranged downstream from the second folding section and serve to guide the sheet S folded in three to pass by.

<First Step in Threefold Processing>

Figure 7:
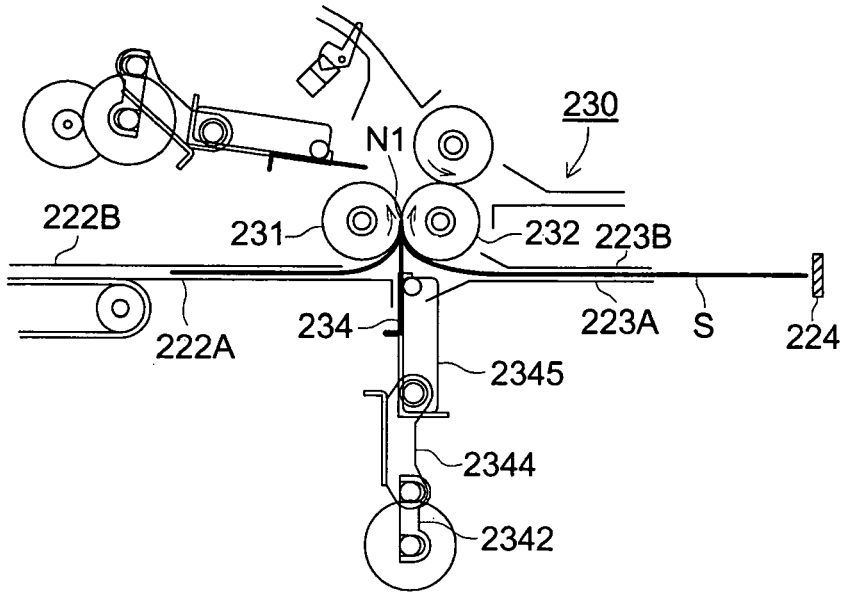
FIG. 7(*a*) and 7(*b*) each is a cross sectional view showing the first folding step in threefold processing.
Figure 7:
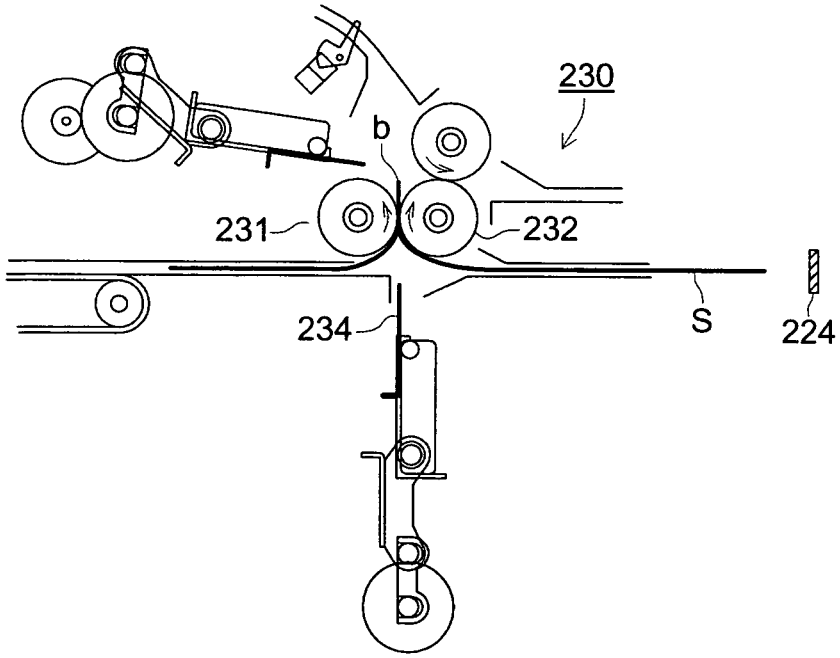

FIG. 7 is a cross sectional view showing the first folding step in threefold processing.

The sheet S having reached the folding process section 230 is transported over the sheet stands 222A and 223A, and is stopped when the leading edge of the sheet has hit the alignment member 224. The set position of the alignment member 224 is where the distance from the position N1 sandwiched between the first folding roller 231 and second folding roller 232 to the sheet abutting surface of the alignment member 224 is one third the overall length L of the sheet S in the longitudinal direction.

The signal for starting threefold processing causes the driving force of the motor M3 to move the first folding plate member 234 forward through an arm plates 2342, link plate 2344 and support member 2345, so that the first folding plate member 234 is projected in an upward direction. The first folding plate member 234 presses into the position of the sheet S so that the sheet S is inserted into the position N1 sandwiched between the first folding roller 231 and second folding roller 232 (FIG. 7(*a*)).

The first folding roller 231 and second folding roller 232 are driven in the arrow-marked directions so that they will rotate in the directions opposite to each other. They sandwich the sheet S and creates the first fold "b". After the first fold "b" has been created, the first folding plate member 234 retracts from the vicinity of the position N1 sandwiched between the first folding roller 231 and second folding roller 232 and gets back to the original position (FIG. 7(*b*)).

<Second Step in Threefold Processing>

Figure 9:
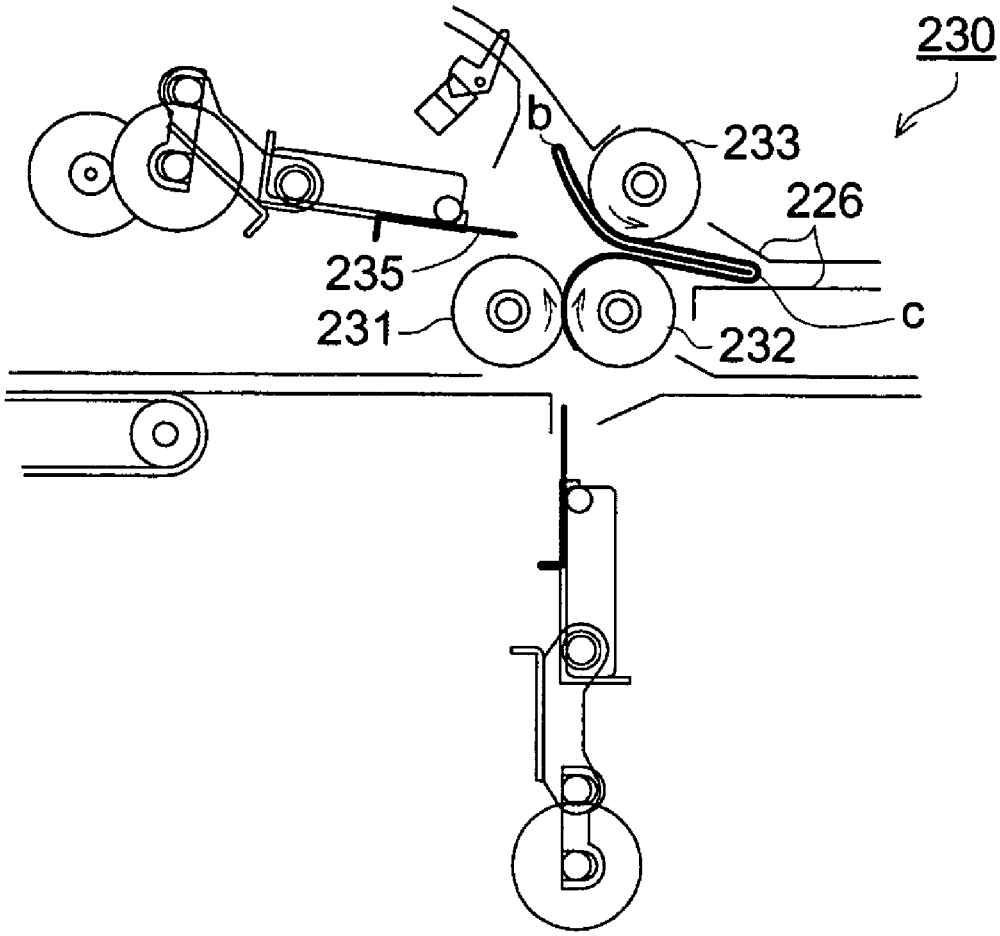
FIG. 9 is a cross sectional view showing the third folding step in threefold processing.

FIGS. 8 and 9 are cross sectional views showing the second folding step in threefold processing.

As shown in FIG. 8(*a*), the sheet S with the first fold "b" created thereon is transported in the state sandwiched between the first folding roller 231 and second folding roller 232, and travels inside a pair of guide plates 225. A predetermined time after the passing of the first fold "b" of the sheet S has been detected by the detecting section 227, the second folding plate member 235 starts to move forward when the motor M4 (FIG.6) has been driven.

As shown in FIG. 8(*b*), the second folding plate member 235 presses the leading edge of the sheet S and the second fold "c" created on the sheet S so that the sheet S will be inserted into the position N2 sandwiched between the second folding roller 232 and third folding roller 233.

As shown in FIG. 9, the second fold "c" is created by the rotation of the second folding roller 232 and third folding roller 233 in mechanical contact with each other. The sheet S internally folded in three is continuously transported by second folding roller 232 and third folding roller 233. After passing through a pair of guide plates 226, the sheet S travels through the transport roller 237 and transport path r8, and is ejected by the ejection roller 238 to be stored in the ejection tray 239 (FIG. 3).

FIG. 10(*a*) is a developed plan showing a sheet to be folded in three. FIGS. 10(*b*), (*c*) and (*d*) show perspective views of the sheet having been subjected to threefold processing in various ways.

FIG. 10(*b*) is a perspective view showing the sheet having been subjected to threefold processing.

The sheet S is folded to have three surfaces by two parallel folds approximately dividing the overall longitudinal length L of the sheet S into three equal parts. The sheet S internally folded in three is folded inside by the first fold "b". It is then folded inside by the second fold "c". The sheet S internally folded in three is suitable for sealing.

FIG. 10(*c*) is a perspective view showing the sheet S externally folded in three in the shape of a letter Z, where the overall longitudinal length L of the sheet S is divided into approximately three equal parts (L/3).

FIG. 10(*d*) is a perspective view of the sheet S externally folded in three in the shape of a letter Z, where a first fold "b" is create at the position one fourth (L/4) of the overall length L of the sheet S, and a second fold "c" is created at the position half the overall length L of the sheet S. This sheet S fold in the shape of a letter Z and reduced to half size is suitable for loading of a file.

In the aforementioned process to produce a plurality of fold ("b" and "c") at a predetermined position, merely by changing the position of the alignment member 224 and the position for stopping the sheet leading edge by the detecting section 227, without modifying the basic configuration of the folding process section 230.

As described above, according to the sheet folding apparatus of the present invention, the folded position is pushed out by a knife-like folding plate member, and this arrangement allows an accurate and firm fold to be obtained, independently of the thickness, quality and size of the sheet. Further, a plurality of sheets are bundled and inserted collectively between the folding rollers. This arrangement solves the problem of misalignment of each sheet.

The sheet folding apparatus, having a saddle stitching function, connected to a copying machine, and sheet folding method has been described with reference to embodiments of the present invention. A post-processing apparatus equipped with the sheet folding apparatus of the present invention can be connected on a selective basis with a multi-folding apparatus for applying a plurality of types of folding to one sheet or a small number of sheets, a fore edge trimming, a side stitching apparatus and a pasting/bookbinding apparatus, thereby providing integrated work flow covering multi-purpose and multi-functional post-processing.

The sheet folding apparatus of the present invention can also be applied to a post-processing apparatus used when connected with an image forming apparatus such as a simplified printing machine, printer, fax machine and multifunction device.

The sheet folding apparatus of the present invention can also be used as an independent post-processing apparatus separated from the image forming apparatus to perform various types of folding processes.

Figure 11:
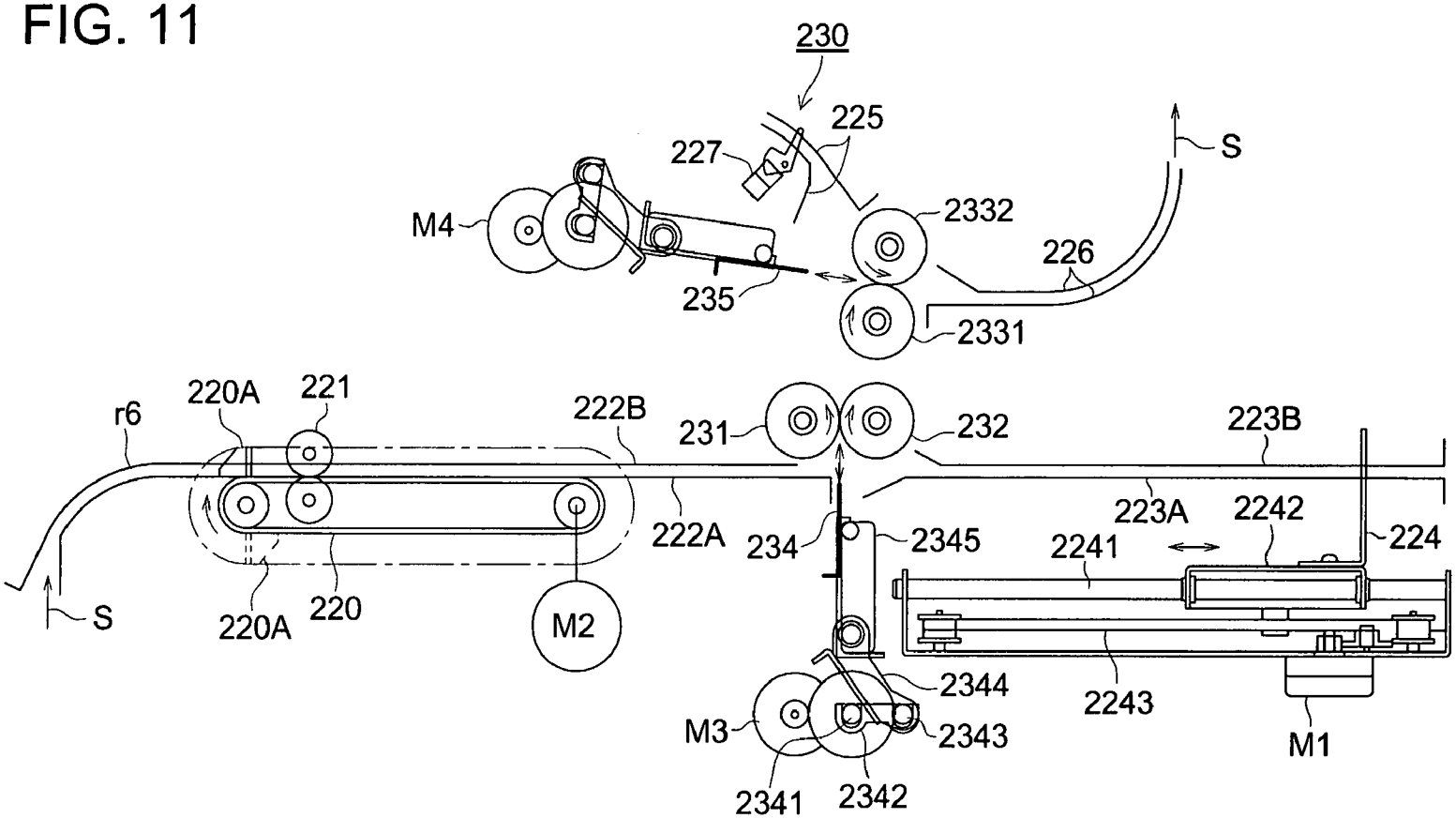
FIG. 11 is a cross sectional view showing another embodiment of the folding section.

The following describes another embodiment:

FIG. 11 shows another embodiment. The configuration bearing the same numeral as FIG. 6 is the same. In this embodiment, the first through fourth folding rollers are provided as a folding roller. The third folding roller 2331 and fourth folding roller 2332 perform the functions of the second folding roller and third folding roller shown in FIG. 6. In this embodiment, use of two knives allows a plurality of sheets of paper to be folded without displacement.

The advantages are provided by the sheet folding apparatus, sheet folding method and post-processing apparatus of the present invention:

According to the sheet folding apparatus and sheet folding method of the present invention, despite the thickness, quality and size of the sheet, a accurate and firm fold can be provided by pushing the position of the sheet where a fold is to be provided, using the knife-like folding plate member.

A plurality of sheets are stacked one on top of another and are pushed out collected by a folding plate member, and are pushed between a pair of rollers. This arrangement solves the problem with misalignment of each sheet of sheets.

A stopping member for stopping a predetermined position by detecting the passing of the leading edge of the sheet with the second sheet created thereon is provided upstream from the second folding section in the direction of sheet transport. This configuration prevents the sheet from being damaged or deformed by a sheet leading edge hitting member having been used so far.

A small number of sheets with folds shaped firmly thereon by the first folding section are sequentially sent to the saddle stitching section, and are stacked to perform saddle-stitching, thereby producing a high-quality booklet containing a little bulge of the fold.

Multifunctional post-processing can be implemented by a post-processing apparatus equipped with a sheet folding apparatus capable of double-folding and threefold processing and a saddle stitching section for collective saddle stitching of double-folded sheets.

What is claimed is:

1. A sheet folding apparatus, for forming a plurality of folds on the sheet on which an image is formed, comprising:

a) a first folding section which comprises a first folding roller, a second folding roller in contact with the first roller, and a knife-like first folding plate member for pushing and inserting the first fold of the sheet between the first and second folding rollers; and b) a second folding section which comprises the second folding roller, a third folding roller in contact with the second folding roller provided downstream from the first folding roller in the sheet feeding direction, a sensor for detecting the passing of the leading edge of the sheet after the first fold being formed, provided upstream from the second folding section and downstream from the first folding section in the sheet feeding direction, and a stopping member for stopping the sheet at a predetermined position by stopping drives of the first and second folding rollers based on the result of detection by the sensor, and a knife-like second folding plate member for pushing and inserting a second fold of the sheet between the second and third folding rollers based on the result of detection by the sensor, wherein after the first fold has been formed on the sheet in the first folding section, the second fold of the sheet is formed in the second folding section.

2. The sheet folding apparatus of claim 1, wherein the sensor detects the passing of the leading edge of the sheet when the portion of the sheet overlapped due to the first fold is sandwiched between the first and second rollers.

3. The sheet folding apparatus of claim 1, wherein the stopping member has a sensor for detecting the passing of the first fold of the sheet ejected from the first folding section.

4. The sheet folding apparatus of claim 1, comprising an alignment member for hitting the loading edge of the sheet and an alignment block for hitting the trailing edge of the sheet against the alignment member to make alignment.

5. A sheet folding method comprising:

a first folding step of forming a first fold by a first tiding roller, a second folding roller in contact with the first roller, and a knife-like first folding plate member for pushing and inserting the first fold of the sheet between the first and second folding rollers; and a second folding step of forming a second fold by the second folding roller, a third folding roller in contact with the second folding roller downstream from the first folding roller in the sheet feeding direction, a sensor for detecting the passing of the leading edge of the sheet after the first fold being farmed, provided upstream from the third folding roller and downstream from the first folding roller in the sheet feeding direction, and a stopping member provided to stop the sheet at a predetermined position by stopping drives of the first and second folding rollers based on the result of detection by the sensor, and a knife-like second folding plate member for pushing and inserting a second fold of the sheet between the second and third folding rollers based on the result of detection by the sensor.

6. The sheet folding method of claim 5, comprising a step of detecting the passing of the leading edge of the sheet by the sensor when the portion of the sheet overlapped due to the first fold is sandwiched between the first and second rollers.

7. The sheet folding method of claim 5, wherein the stopping member has a sensor for detecting the passing of the first fold of the sheet ejected from the first folding section.

8. The sheet folding method of claim 5, wherein there is an alignment member for hitting the leading edge of the sheet and an alignment block for hitting the trailing edge of the sheet against the alignment member to make alignment.

9. A sheet folding apparatus, for forming a plurality of folds on the sheet on which an image is formed, comprising:

a) a first folding section which comprises a first folding roller, a second folding roller in contact with the first roller, and a knife-like first folding plate member for pushing and inserting the first fold of the sheet between the first and second folding rollers; and b) a second folding section which comprises a third folding roller provided downstream from the first and second folding rollers in the sheet feeding direction, a fourth roller in contact with the third folding roller, a sensor for detecting the passing of the leading edge of the sheet after the first fold being formed, provided upstream from the second folding section and downstream from the first folding section in the sheet feeding direction, and a stopping member for stopping the sheet at a predetermined position by stopping drives of the first and second folding rollers based on the result of detection by the sensor, and a knife-like second folding plate member for pushing and inserting a second fold of the sheet between the third and fourth folding rollers based on the result of detection by the sensor, wherein after the first fold has been formed on the sheet in the fret folding section, the second fold of the sheet is formed in the second folding section.

10. The sheet folding apparatus of claim 9, wherein the second folding roller is the same as the third folding rollers.

11. The sheet folding apparatus of claim 9, wherein the sensor detects the passing of the leading edge of the sheet when the portion of the sheet overlapped due to the first fold is sandwiched between the first and second rollers.

* * * * *